US005133233A

United States Patent [19]

Erwin

[11] Patent Number: 5,133,233

[45] Date of Patent: Jul. 28, 1992

[54] BOTTLE OPENER GLOVE

[76] Inventor: Charles M. Erwin, 6209 Partride Dr., Virginia Beach, Va. 23464

[21] Appl. No.: 757,003

[22] Filed: Sep. 9, 1991

[51] Int. Cl.[5] ..... B67B 7/16

[52] U.S. Cl. ..... 81/3.57; 2/160

[58] Field of Search ..... 81/3.07, 3.09, 3.4, 81/3.55, 3.57; 2/160, 159, 161 R; 30/298; 294/25; 7/151

[56] References Cited

U.S. PATENT DOCUMENTS

| | | | |
|---|---|---|---|
| D. 51,962 | 4/1918 | Januchowsky | 81/3.57 |
| 681,872 | 8/1899 | Johnston | 81/3.57 |
| 888,580 | 5/1908 | Brinn | 81/3.57 |
| 917,527 | 4/1909 | Blair | 30/298 |
| 983,454 | 2/1911 | Ludwig | 30/298 |
| 1,578,627 | 3/1926 | Baumgarten | 81/3.57 |
| 2,548,517 | 4/1951 | Clark | 81/3.57 |
| 2,702,906 | 3/1955 | Causse | 2/159 |
| 3,495,284 | 2/1970 | Weingardt | 81/3.57 |
| 3,500,477 | 3/1970 | Meszaros | 2/161 R |
| 4,894,866 | 1/1990 | Walker | 2/159 |

*Primary Examiner*—Roscoe V. Parker
*Attorney, Agent, or Firm*—Stephen E. Clark

[57] ABSTRACT

Bottle opening tool having bottle cap-engaging hook and end fulcrum bar, each secured to a rigid back plate, is incorporated into the palm of a glove. Back plate is shaped to conform to the shape of the palm of the wearer'hand. Bottle cap is removed by back of user's hand applying lifting force to glove. Entire bottle opening tool member fits within palm of glove, thereby leaving fingers unrestricted to movement both while opening bottles and when not being used to open bottles.

7 Claims, 5 Drawing Sheets

BOTTLE OPENER GLOVE

FIELD OF INVENTION

The present invention relates to bottle-opening tools. In particular, the present invention relates to intermediate hook and end fulcrum-type bottle openers, in which the opener tool is incorporated into the construction of a glove.

BACKGROUND

Bottle caps can generally be removed from glass beverage bottles by one of two methods: The cap may either be twisted off; or it may be pried off. By far, the most common method of prying caps off of bottles involves the use of a bottle opening tool having a handle, an intermediate hook, and an end fulcrum.

Typically, prior intermediate hook and end fulcrum-type bottle openers all have extended handles which the operator of the opener pulls up on in order to remove the cap from the bottle. In most cases the handle is several inches long, thereby effecting a relatively high mechanical advantage, and providing ample length to be grasped in the hand of the operator. U.S. Pat. No. Des. 51,962 is an example of this prior type of bottle opener.

A problem with such prior devices is that the openers can be easily lost, misplaced, borrowed, or stolen when they are not in use. This may be a particular problem for a professional bar tender who puts down his opener, for example, to mix drinks, and subsequently has to search for the misplaced opener before opening another bottled beverage.

Another problem of such prior devices is that in order to provide ample leverage to pry the cap open, the typical handles of such devices are relatively long (typically 4 to 6 inches). In order to use such prior devices the operator must use his entire hand (or in any event, all the fingers of one hand) to grasp and lift the opener handle. Accordingly, with such prior devices the operator must release everything else from this hand in order to use the opener.

Another problem of such prior devices is that because the handles are several inches long they require a corresponding amount of space for storage. Not only can this characteristic of such prior openers make storage difficult, but it also renders such tools awkward to carry around.

In order to make bottle openers more compact, and thus more transportable, various designs have been proposed, each of which effectively reduces the length of the handle. In some cases, (such as U.S. Pat. No. 631,872), the handle is simply collapsible and folds out when in use to provide sufficient mechanical advantage; in other cases (such as U.S. Pat. Nos. 1,578,627; 888,580; 3,495,284; and 2,548,517) rings are provided for the fingers or knuckles to compensate for the reduced leverage provided by such tools. A problem with the former (i.e. collapsible) design is that it actually takes two hands to operate (i.e. open) the tool, and the hook of such devices must inherently be of narrow width. A problem with the latter (i.e. finger and knuckle ring-type levers) is that they are awkward and painful to operate over long periods of time.

In order to alleviate the problems discussed above which are associated with prior handle-hook-fulcrum type bottle openers, many bottled beverages are provided with caps which can be opened both by bottle openers and by hand-twisting of the cap. However, It has been found by professional bar tenders that, when large numbers (i.e. dozens) of bottles are to be opened at a time, such "twist" caps can be more easily, more efficiently, and more quickly removed by using a handle-hook-fulcrum type bottle opening tool.

OBJECTS

Accordingly, it is a primary object of the present invention to provide a hook and fulcrum-type bottle opening device which is comfortably worn by the operator.

It is another object of the present invention to provide a device of the character described that does not require the use of the operator's fingers or thumb in order to remove a cap from a bottle.

It is another object of the present invention to provide a device of the character described in which a bottle opening tool is comfortably worn in the palm of the operator's hand.

It is another object of the present invention to provide a device of the character described in which the bottle opening tool is incorporated into a glove which is worn by the operator.

It is another object of the present invention to provide a device of the character described in which the "handle" of the bottle opening tool generally conforms to the shape of the palm of a human hand.

It is another object of the present invention to provide a device of the character described in which the "handle" of the bottle opening tool is of sufficient area to protect the operator's hand from injury during operation.

It is another object of the present invention to provide a device of the character described in which a single size of glove can be worn on different sized hands.

It is another object of the present invention to provide a device of the character described which can be comfortably worn by a bartender, when not being used to open bottles, without significantly encumbering or inhibiting the use of the wearer's hand.

Further objects and advantages of my invention will become apparent from a consideration of the drawings and ensuing description thereof.

DRAWINGS

DESCRIPTION

The preferred embodiment of the invention essentially comprises a glove member (generally designated 1 in the figures) adapted to be worn on a human hand H, and a bottle opening tool member (generally designated 2 in the figures).

The glove member 1 is preferably constructed of a washable fabric such as cotton, polyester, dacron, or a combination thereof, but may be constructed of any common glove material.

Figure 3:
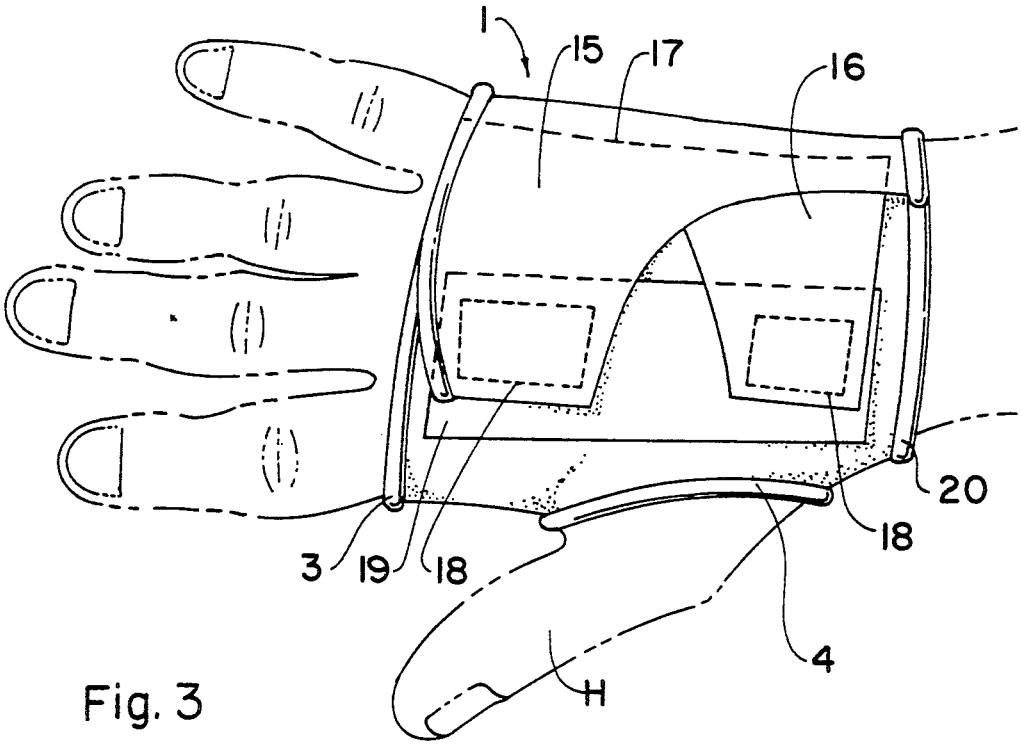
FIG. 3 is a perspective view showing the back side of the preferred embodiment of the invention as worn on a hand.

Referring to FIG. 3: In the preferred embodiment of the invention, the glove member 1 is provided with a hemmed fingers-side edge 3, a hemmed wrist-side edge 20, a hemmed longitudinal edge 17, two adjustment straps 15 and 16, and a hemmed thumb opening 4.

Figure 4:
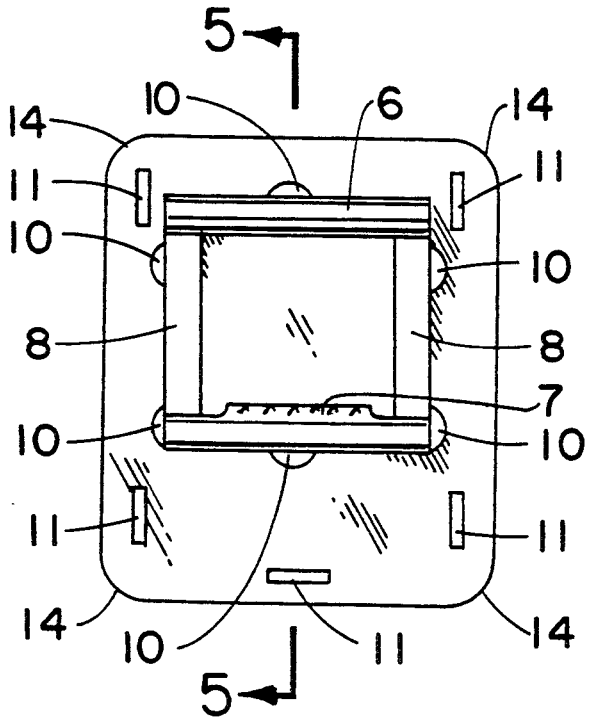
FIG. 4 is a plan view showing in detail the construction of the bottle-opening tool of the present invention.
Figure 5:
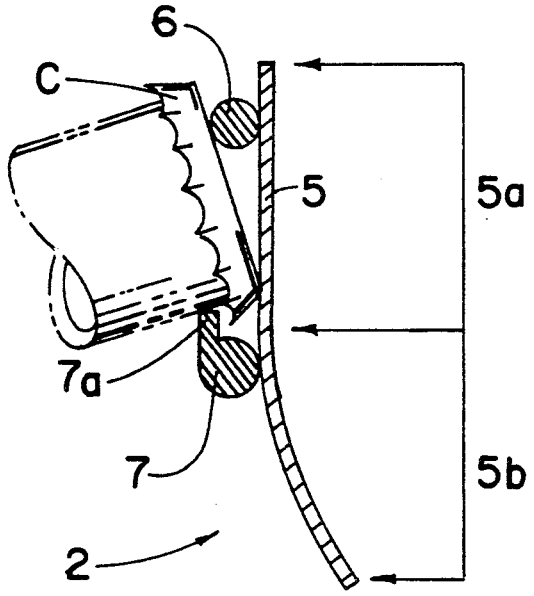
FIG. 5 is a cross-sectional view of the bottle-opening tool taken along the line 5—5 of FIG. 4.

Referring to FIGS. 4 and 5, the bottle opening tool member 2 comprises a back plate 5, and a fulcrum bar 6 and a bottle cap prying "hook" 7 which are rigidly attached to the front of the back plate 5.

In the preferred embodiment of the invention, the bottle opening tool member 2 is constructed of a corrosion-resistant, rigid metal such as aluminum, stainless steel, or coated (i.e. plated or painted) steel.

Preferably, a pair of side bars 8 extend from the ends of the fulcrum bar 6 to the ends of the hook 7, respectively, so as to effect a recessed area 9 inside of the fulcrum bar 6, hook 7 and side bars 8, into which the capped end C of a bottle may be partially inserted (as shown in FIG. 5). The side bars 8 are welded 10 to the back plate 5.

Figure 8:
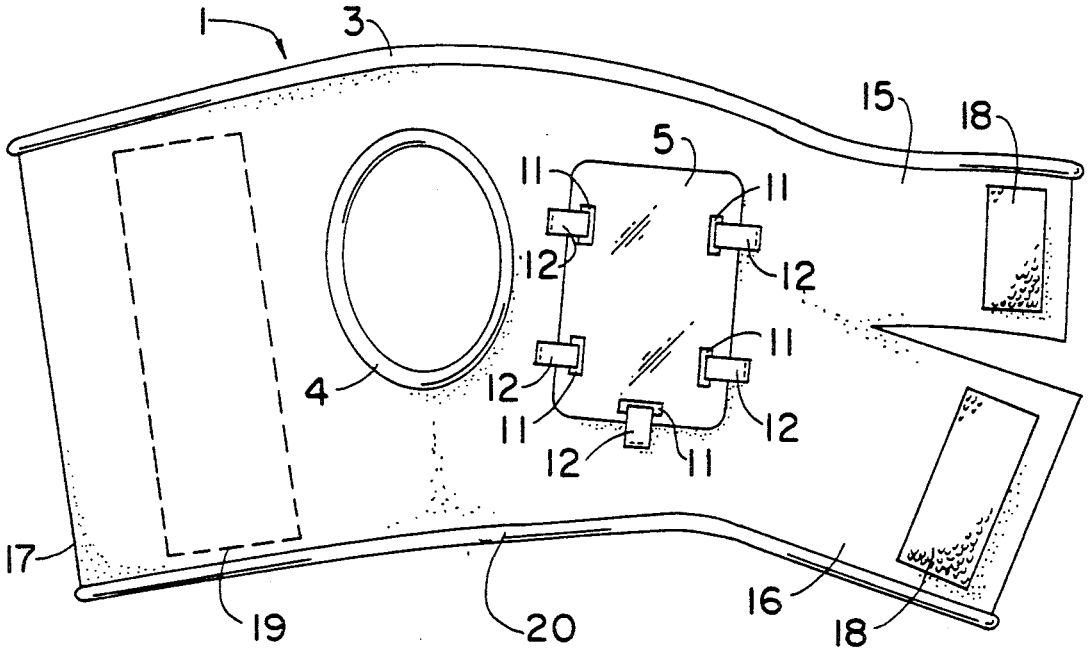
FIG. 8 is a plan view showing the inside of the preferred embodiment of the invention, with the glove member un-wrapped.

Referring to FIG. 8: The bottle opening tool member 2 subassembly is attached to the inside of the palm of the glove member 1 by fastening straps 12 which are threaded through holes 11 in the back plate 5. In the preferred embodiment of the invention the bottle opening tool member 2 subassembly is attached to the glove member 1 by fabric fastening straps 12 which are permanently sewn into the inside of the palm of the glove 1.

Figure 1:
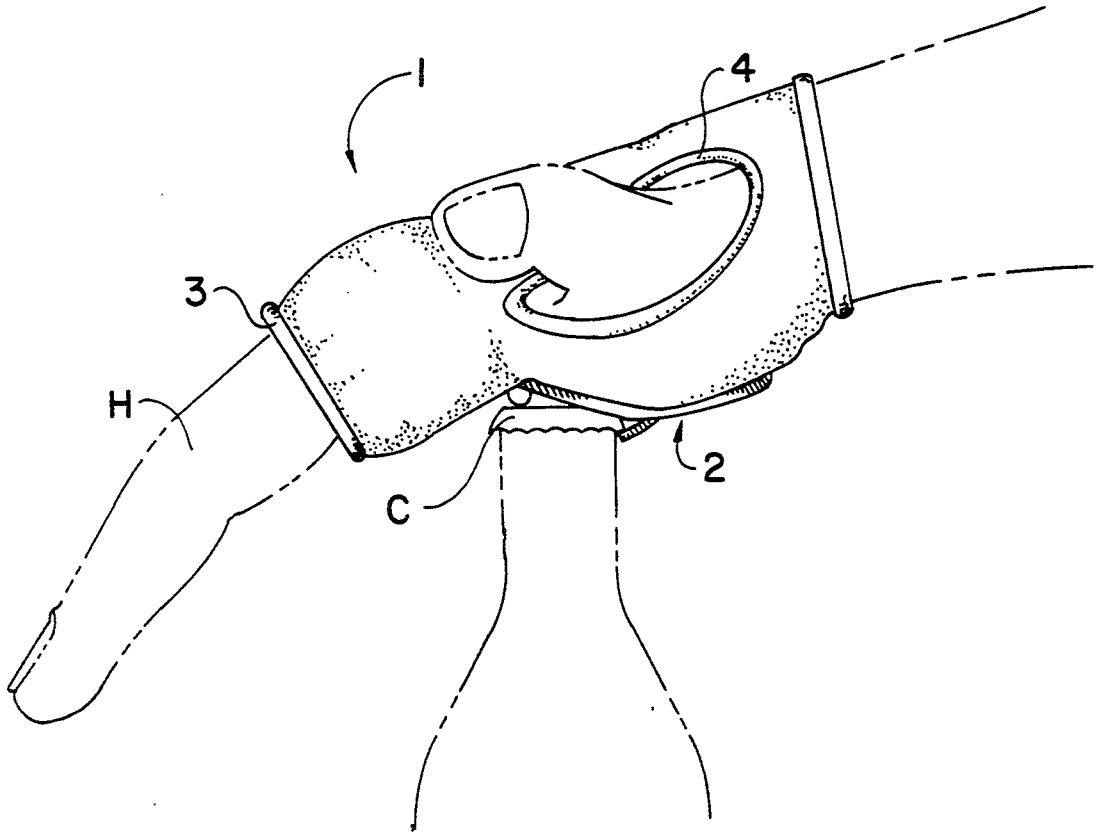
FIG. 1 is a perspective view showing the invention being used to remove a cap from a bottle.
Figure 2:
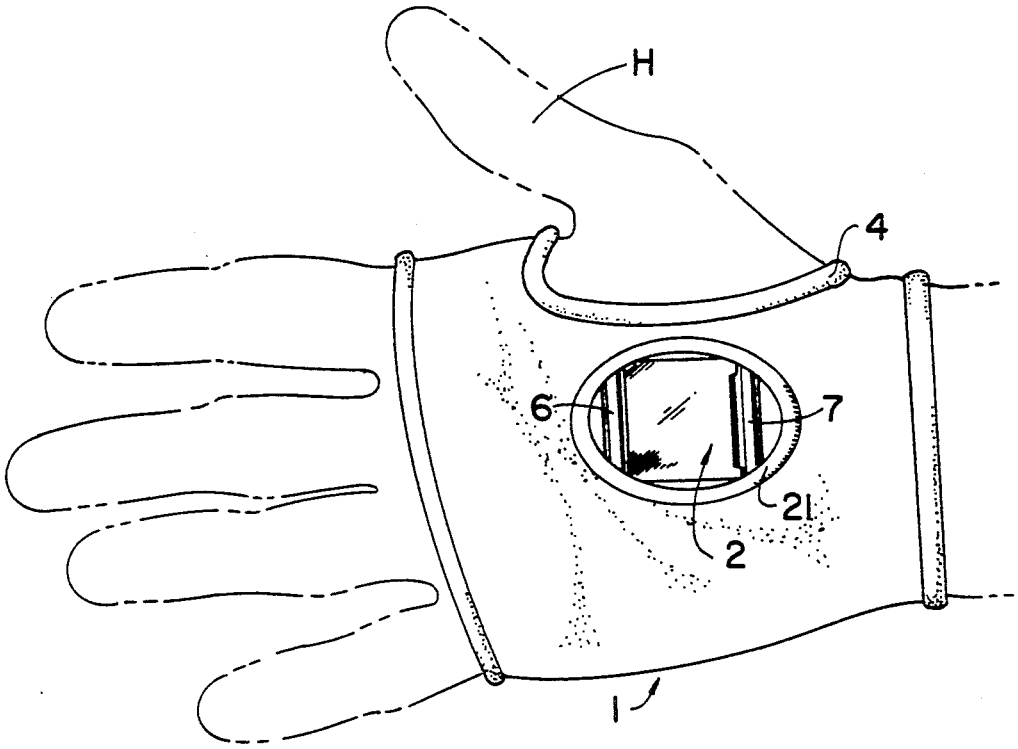
FIG. 2 is a perspective view showing the front side of the preferred embodiment of the invention as worn on a hand.

A hemmed opening 21 is provided in the palm of the glove 1 through which the hook 7 and fulcrum bar 6 are accessible from the outside of the glove 1 (as shown in FIG. 2).

In an alternate construction of the invention, (shown in FIG. 7), the bottle opening tool subassembly 2 is secured to the outside of the palm of the glove 1 with fastening straps 12; and a continuous hemmed flap 13 is sewn onto the outside of the palm of the glove 1 and around the perimeter of the opening tool subassembly 2. The unattached side of the flap 13 extends over the perimeter of the back plate 5, preferably covering the outer edge of the back plate 5, as well as the fastening straps 12.

Referring to FIGS. 4 and 5: The back plate 5 is preferably shaped as a quadralateral whose four corners 14 are each rounded so as to prevent injury to the wearer of the device and so as to prevent damage or gouging of the glove 1 by the back plate 5. The back plate 5 is preferably sized such that it entirely fits within the palm (including the heel of the palm) of the glove 1.

In the preferred embodiment of the invention, the back plate 5 is laterally symmetric, and is longitudinally defined by an upper section **5*a* and a lower section 5*b*. The back plate 5 is attached to the palm of the glove 1 such that the upper section 5*a* of the back plate is in a position corresponding to the central palm of the hand H of the wearer of the glove 1; and the lower section 5*b* of the back plate is in a position corresponding to the heel of the palm of the wearer of the glove 1. The lower section 5*b* of the back plate is preferably slightly angled inward (i.e. toward the wearer's hand), and gradually curved (as shown in FIG. 5**) to generally conform to the shape of the heel of the palm of a human hand.

In the preferred embodiment of the invention, the hook 7 has an inside edge **7*a* adapted to engage the underside of the edge of a capped bottle C, and is positioned a finite distance from the front of the back plate 5**.

Referring to FIG. 3: In the preferred embodiment of the invention, two adjustments straps 15 and 16 extend over the longitudinal edge 17 of the back side of the glove 1. Each adjustment strap 15 and 16, respectively, is provided with a small swatch of Velcro "hook" material 18 by which the adjustment straps 15 and 16 may be tightened and secured to a corresponding swatch of Velcro "loop" material 19 which is permanently sewn onto the backhand side of the glove 1.

The glove 1 is worn in typical fashion on a human hand H. That is: the thumb is inserted through the thumb hole 4, and the fingers extend beyond the hemmed fingers edge 3 of the glove. The back of the back plate 5 faces toward the palm of the hand H, and the hook 7 and fulcrum bar 6 face away from the hand H. The adjustment straps 15 and 16 are pulled snug around the back of the hand H and secured in place by use of the corresponding Velcro fasteners 18 and 19, respectively.

The caped end of a bottle C is inserted into the recessed area 9 of the bottle opening tool 1, such that the hook 7 engages the bottle cap C. The operator removes the cap C from the bottle by pivoting his hand H about the fulcrum bar 6 and prying the hooked edge of the cap C away from the bottle.

It will be appreciated by those skilled in the art that the disclosed bottle opening tool 2 effects a type of lever wherein the fulcrum bar 6 acts as the "fulcrum"; the "load" is applied to the hook 7; and the "force" is applied by the hand H of the operator either by pulling against the lower section **5*b* of the back plate or by pushing against the upper section 5*a* of the back plate (above the fulcrum bar 6). In the preferred embodiment of the invention, the lower section 5*b* of the back plate extends farther below the hook 7 than the upper section 5*a* of the back plate extends above the fulcrum bar 6. Thus, it will be appreciated that, in the preferred embodiment of the invention, the greater mechanical advantage is realized by the operator's pulling against the lower end of the bottle opening tool 2** than by pushing against the upper end of the bottle opening tool.

The operator applies a pulling force to the lower end **5*b* of the back plate by pulling the palm of his hand H away from the capped bottle C. The actual force of the operator's hand H is transmitted to the glove 1 by the back of the hand's pushing against the inside of the back of the glove 1. This force in turn is transmitted through the fibers of the glove 1 to the fastening straps 12 near the bottom of the back plate 5*b*; and this force, in turn, is transmitted directly to the bottle opening tool 2. Thus, it will be appreciated by those skilled in the art that the "pulling" force applied to the bottom end 5*b*** of the bottle opening tool is the resultant of the force provided by the (lower) back of the operator's hand H.

As mentioned previously, the leveraged opening force applied by the hook 7 to open the capped bottle C can be supplemented by the operator's hand H pushing against the upper end 5*a* of the back plate. In the preferred embodiment of the invention the upper end 5*a* of the back plate is located in the palm of the glove 1 in a position corresponding to the central palm of the operator's hand H.

It will be appreciated that because the bottle opening tool is sized to fit entirely in the palm of the operator's hand, is shaped so as to generally conform to the shape of the palm (including the heel of the palm) of the operator's hand, and because the glove member 1 is preferably constructed without finger or thumb coverings, the disclosed device can be comfortably worn by the operator with only minimally diminished manual dexterity at all times, regardless of whether or not the device is being continuously used to open capped bottles.

In the preferred embodiment of the invention the back plate 5 is quadralaterally shaped, having an area of between 3 and 8 square inches.

Figure 7:
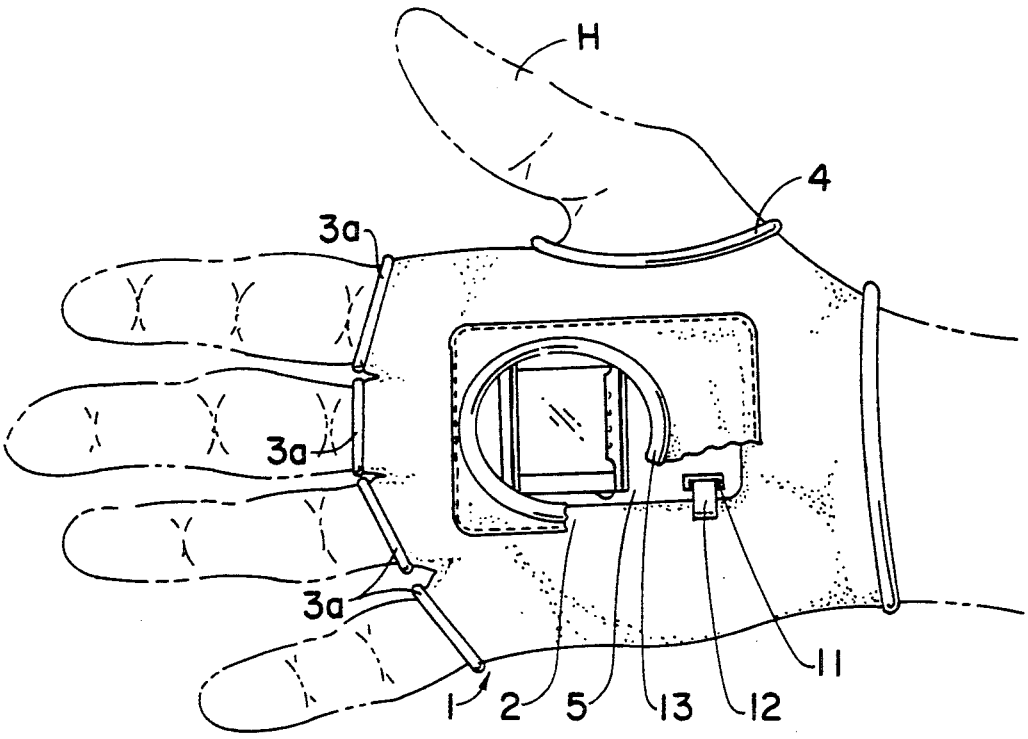
FIG. 7 is a perspective view showing the forehand side of the modification of the present invention shown in FIG. 6.

It will be appreciated by those skilled in the art that the disclosed construction of the device protects the operator's hand H from injury, primarily due to the fact that the relatively broad back plate 5 guards the operator's hand from the bottle and the bottle cap; and because the hemmed opening 21 (or alternatively, the hemmed flap 13 as shown in FIG. 7) covers the edge of the back plate, as well as the welds 10, and thereby reduces the chance of the bottle's becoming chipped or broken against abrupt or sharp edges of the device; and because the glove itself covers almost the entire hand and thereby protects the operator's hand.

Figure 6:
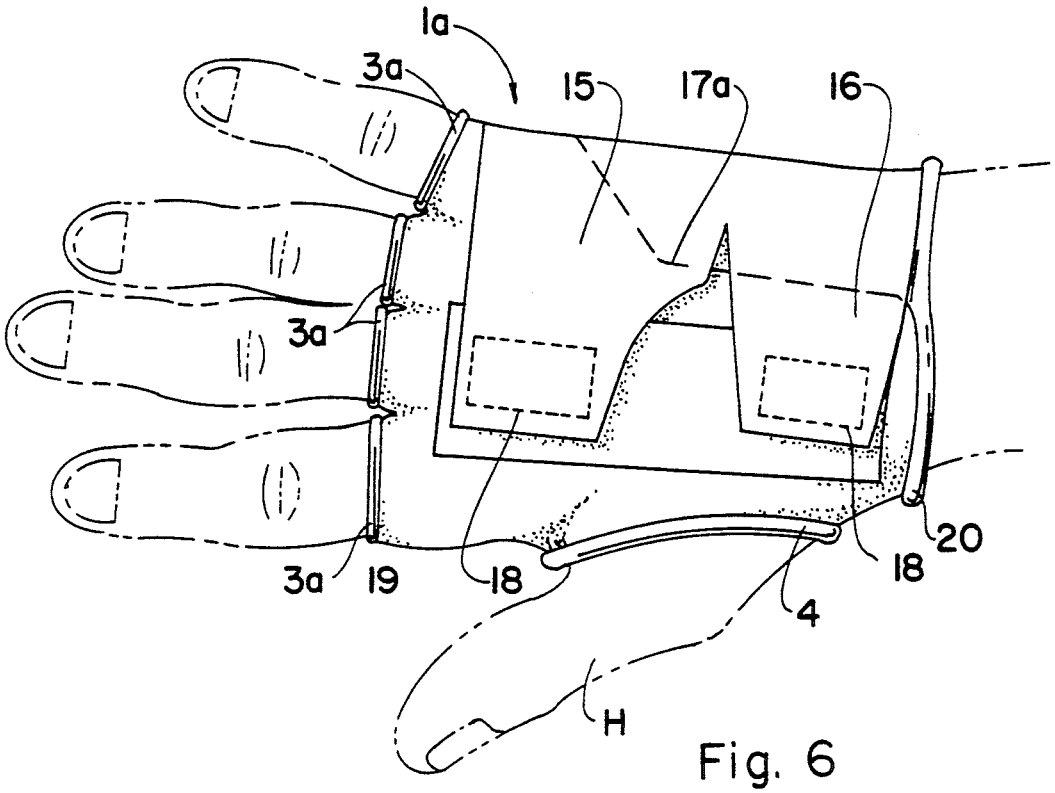
FIG. 6 is a perspective view showing the back-hand side of a modification of the present invention incorporating a glove having individual finger holes.

While the above description contains many specificities, these should not be construed as limitations on the scope of the invention, but rather as an exemplification of one preferred embodiment thereof. Many other variations are possible, for example:

The back plate may be perforated so as to allow for cooler and lighter operation;

The hook and fulcrum bar of the opener may be formed out of the back plate itself rather than constructed of separate parts which are attached to the back plate;

The back plate may be constructed of a non-metallic, rigid material;

The bottle opening tool member 2 may be secured to the palm of the glove 1 by temporary means (such as Velcro straps, lacings, snap fasteners, etc.) or by permanent means (such as adhesives, sewing, etc.);

The glove may be provided either with or without adjustment straps 15 and 16;

The glove may be provided either with or without hemmed flaps 13 or other covering over the edge of the back plate;

The longitudinal edge 17 of the back of the glove may extend all the way from the "wrist" of the glove to the opposite (i.e. finger) side of the glove, as shown in FIGS. 3 and 8, in which case the "glove" is simply wrapped around the operator's hand; or the glove may be provided with finger holes 3*a* and longitudinal edge 17*a*, (as shown in FIGS. 6 and 7), in which construction the hand may simply be inserted into the glove; or, The glove may be provided either with individual finger holes 3*a*, or may altenatively be provided with a single extended opening through which two or more fingers can be inserted.

Accordingly, the scope of the invention should be determined not by the embodiment illustrated, but by the appended claims and their legal equivalents.

I claim:

1. A device for removing caps from bottles, comprising:

a glove member adapted to be worn on a human hand;

a bottle cap prying member;

said cap prying member being attached to the palm of said glove member;

wherein said bottle cap prying member comprises a rigid, bottle cap engaging member;

wherein said bottle cap prying member further comprises a rigid plate member, said plate member having a front side and a back side, and said back side of said rigid plate member facing toward said palm of said glove member;

wherein an intermediate portion of said bottle cap engaging member is disposed a finite distance away from the front side of said rigid plate member;

wherein said bottle cap prying member further comprises a fulcrum member, said fulcrum member being disposed on said front side of said rigid plate member and having an axis substantially parallel to said intermediate portion of said bottle cap engaging member;

and wherein:

said fulcrum member comprises an elongated member having a first end and a second end;

and wherein said bottle cap engaging member comprises an elongated member having a first end and a second end;

and further comprising a first rigid side member extending from said first end of said fulcrum member to said first end of said bottle cap engaging member;

and a rigid second rigid side member extending from said second end of said fulcrum member to said second end of said bottle cap engaging member.

2. The device according to claim 1 further comprising means for attaching said cap prying member to said glove member.

3. The device according to claim 2 wherein said means for attaching said cap prying member to said glove member comprises:

a plurality of fastening strap members, said fastening strap members each being sewn to said glove member, and said fastening strap members further being attached to said rigid plate member.

4. The device according to claim 3 wherein said rigid plate member has a substantially quadralaterally shaped perimeter.

5. The device according to claim 4 further comprising means for covering said quadralaterally shaped perimeter of said rigid plate member, said covering means comprising a continuous flaccid border member having a first edge and a second edge, wherein said first edge of said border member is attached to said palm of said glove member, and wherein the total length of said second edge of said border member is less than the total length of said quadralateral perimeter of said rigid plate member.

6. The device according to claim 5 further comprising means for adjusting the girth of said glove member.

7. A device for removing caps from bottles, comprising:

a glove member adapted to be worn on a human hand, said glove member having a forward end generally corresponding to the distal end of said hand on which the glove member is adapted to be worn;

a bottle cap prying member;

said cap prying member being attached to the palm of said glove member;

wherein said bottle cap prying member comprises a rigid, bottle cap engaging member;

wherein said bottle cap prying member further comprises a rigid plate member, said plate member having a front side and a back side, and said back side of said rigid plate member facing toward said palm of said glove member;

wherein said bottle cap prying member further comprises a fulcrum member, said fulcrum member being disposed on said front side of said rigid plate member;

and wherein said bottle cap engaging member comprises a hook member attached to said front side of said rigid plate member, said hook member having a distal end substantially directed toward said forward end of said glove member, and said fulcrum member being disposed between said distal end is said hook member and said forward end of said glove member; and said distal end of said hook member being a finite distance away from said front side of said rigid plate member.

* * * * *